US008784988B2

(12) United States Patent
Lopez et al.

(10) Patent No.: US 8,784,988 B2
(45) **Date of Patent: *Jul. 22, 2014**

(54) POLYMER INORGANIC-PARTICULATE COMPOSITE FIBERS

(75) Inventors: Leonardo C. Lopez, Midland, MI (US); Scott T. Matteucci, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 1084 days.

This patent is subject to a terminal disclaimer.

(21) Appl. No.: 12/623,330

(22) Filed: Nov. 20, 2009

(65) Prior Publication Data

US 2010/0129634 A1 May 27, 2010

Related U.S. Application Data

(60) Provisional application No. 61/117,791, filed on Nov. 25, 2008.

(51) Int. Cl.

| | |
|---|---|
| ***D02G 3/00*** | (2006.01) |
| ***B32B 5/16*** | (2006.01) |
| ***B32B 27/12*** | (2006.01) |

(52) U.S. Cl.

USPC ..... 428/372; 428/364; 428/365; 428/394; 428/395; 428/323; 442/394

(58) Field of Classification Search

None

See application file for complete search history.

(56) References Cited

U.S. PATENT DOCUMENTS

| | | | | |
|---|---|---|---|---|
| 3,493,544 | A * | 2/1970 | Hurworth et al. | 528/341 |
| 4,343,743 | A * | 8/1982 | Coquard et al. | 564/123 |
| 5,049,295 | A * | 9/1991 | Takemura et al. | 252/62.54 |
| 6,172,167 | B1 | 1/2001 | Stapert et al. | |
| 8,268,042 | B2 * | 9/2012 | Lopez et al. | 95/52 |
| 8,343,257 | B2 * | 1/2013 | Matteucci et al. | 95/45 |
| 2008/0214743 | A1 | 9/2008 | Broos et al. | |
| 2010/0041292 | A1 | 2/2010 | Kim et al. | |
| 2010/0041296 | A1 * | 2/2010 | Lopez et al. | 442/351 |
| 2010/0041857 | A1 | 2/2010 | Harris et al. | |
| 2010/0126341 | A1 | 5/2010 | Matteucci et al. | |
| 2010/0126342 | A1 | 5/2010 | Lopez et al. | |
| 2010/0127434 | A1 | 5/2010 | Broos et al. | |
| 2010/0129591 | A1 * | 5/2010 | Lopez et al. | 428/87 |
| 2010/0129634 | A1 * | 5/2010 | Lopez et al. | 428/221 |
| 2010/0129641 | A1 | 5/2010 | Lopez et al. | |
| 2010/0137478 | A1 | 6/2010 | White et al. | |

FOREIGN PATENT DOCUMENTS

| | | |
|---|---|---|
| EP | 376323 | 4/1990 |
| WO | 2007030791 | 3/2007 |
| WO | 2009134824 | 9/2007 |
| WO | 2008101051 | 8/2008 |
| WO | 2007099397 | 9/2008 |
| WO | 2008150970 | 12/2008 |
| WO | 2008112833 | 11/2009 |

OTHER PUBLICATIONS

Krook et al., "Barrier and Mechanical Properties of Injection Molded Montmorillonite/Polyesteramide Nanocomposites"; Polymer Engineering and Science (2005), pp. 135-141.*

(Continued)

*Primary Examiner* — Jill Gray

(57) ABSTRACT

The instant invention generally provides polymer inorganic-particulate composite fiber comprising a molecularly self-assembling material and an inorganic-particulate, and a process of making and an article comprising the polymer inorganic-particulate composite fiber.

14 Claims, 3 Drawing Sheets

(56) References Cited

OTHER PUBLICATIONS

Chang et al., "Poly(trimethylene terephthalate) Nanocomposite Fibers Comprising Different Organoclays: Thermomechanical Properties and Morphology", Journal of Applied Polymer Science, 2006, vol. 102, pp. 4535-4545, Wiley Periodicals, Inc.

Ciferri, Alberto, "Supramolecular Polymers", Second Edition, 2005, pp. 157-158, CRC Press.

Corbin et al., "Chapter 6 Hydrogen-Bonded Supramolecular Polymers: Linear and Network Polymers and Self-Assembling Discotic Polymers", Supramolecular Polymers, 2nd edition, CRC Press, 2005, pp. 153-182.

Houphouet-Boigny et al., "Towards Textile-Based Fiber-Reinforced Thermoplastic Nanocomposites: Melt Spun Polypropylene-Montmorillonite Nanocomposite Fibers", Polymer Engineering and Science, 2007, vol. 47, pp. 1122-1132, Wiley InterScience.

Jung et al., "Poly(ethylene terephthalate) Nanocomposite Fibers With New Organomica Via In Situ Intercalation", Polymer Engineering and Science, 2007, pp. 1820-1826, Wiley InterScience.

Koevoets et al., "Molecular Recognition in a Thermoplastic Elastomer", Journal of the American Chemical Society, 2005, pp. 2999-3003, vol. 127.

Lips et al., "Incorporation of different crystallizable amide blocks in segmented poly(ester amide)s", Polymer, 2005, pp. 7834-7842, vol. 46, Elsevier Ltd.

Lips et al., "Synthesis and characterization of poly(ester amide)s containing crystallizable amide segments", Polymer, 2005, pp. 7823-7833, vol. 46, Elsevier Ltd.

Liu et al., "The preparation and properties of biodegradable polyesteramide composites reinforced with nano-CaCO3 and nano-SiO2", Materials Letters, 2007, vol. 61, pp. 4216-4221, Elsevier B.V.

* cited by examiner

POLYMER INORGANIC-PARTICULATE COMPOSITE FIBERS

CROSS-REFERENCE TO RELATED APPLICATION(S)

This application claims benefit of priority from U.S. Provisional Patent Application No. 61/117,791, filed Nov. 25, 2008, which application is incorporated by reference herein in its entirety.

The present invention is in the field of polymer inorganic-particulate composite fibers.

BACKGROUND OF THE INVENTION

There is a need in the polymer art for new polymer inorganic-particulate composite fibers, and articles comprising the polymer inorganic-particulate composite fibers.

SUMMARY OF THE INVENTION

In a first embodiment, the instant invention is a polymer inorganic-particulate composite fiber comprising a molecularly self-assembling (MSA) material and an inorganic particulate dispersed in the MSA material, wherein the inorganic particulate comprises a metal hydroxide or an inorganic clay, the inorganic clay comprising a cation exchanging layered material and inorganic cations, the cation exchanging layered material having a cation exchanging capacity, the polymer inorganic clay composite fiber having an average diameter and the inorganic particulate having at least two dimensions that are less than 10% of the average diameter of polymer inorganic clay composite fiber, the inorganic particulate comprising from 1 weight percent (wt %) to 90 wt % of the polymer inorganic-particulate composite fiber based on total weight of the polymer inorganic-particulate composite fiber. In some embodiments, the inorganic particulate comprises the inorganic clay. The inorganic clay is not magadiite or a synthetic hydrous magnesium silicate clay. In other embodiments, the inorganic particulate comprises the metal hydroxide. Preferably, the polymer inorganic-particulate composite fiber has an average diameter of from 0.010 micrometer (μm) to 30 μm.

In a second embodiment, the instant invention is a process for fabricating the polymer inorganic-particulate composite fiber of the first embodiment, the process comprising the step of: extruding a mixture comprising the inorganic particulate and a first melt comprising the MSA material under fiber forming conditions to give the polymer inorganic clay composite fiber of the first embodiment.

In a third embodiment, the instant invention is an article comprising the polymer inorganic-particulate composite fiber of the first embodiment. In some embodiments, the article comprises a porous filter medium (e.g., for filtering air, gasses, or liquids), wound dressing (e.g., bandage), textile (e.g., fabric), carpeting, structure reinforcing material, antistatic medium, conductive medium (electrical or magnetic), or catalyst medium. In other embodiments, the article comprises packaging, blow molded articles, thermal insulation, electrical insulation, or an electrical conductor. In still other embodiments, the article comprises a medical gown, medical tissue scaffold, cosmetic applicator, sound insulation, barrier material, diaper coverstock, adult incontinence pants, training pants, underpad, feminine hygiene pad, wiping cloth, durable paper, fabric softener, home furnishing, floor covering backing, geotextile, apparel, apparel interfacing, apparel lining, shoe, industrial garment, protective garments and fabrics, agricultural fabric, automotive fabric, automotive component (e.g., internal door panel), coating substrate, laminating substrate, leather, or electronic component.

Additional embodiments of the present invention are illustrated in the accompanying drawings and are described in the following detailed description and claims.

DETAILED DESCRIPTION OF THE INVENTION

Figure 1:
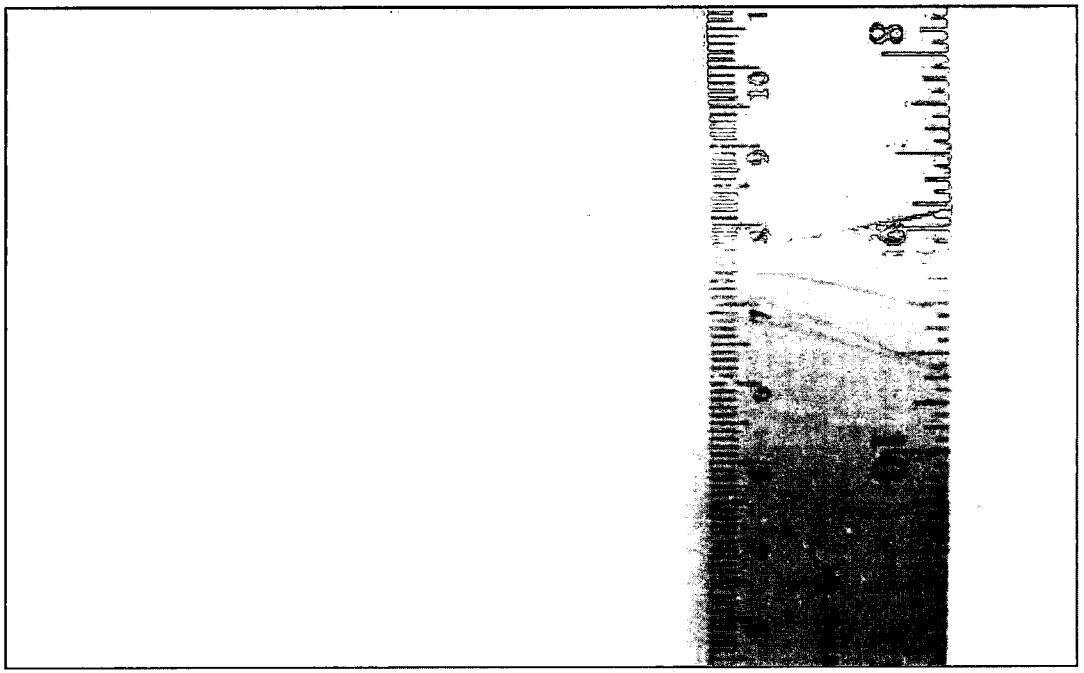
FIG. 1 is a photograph of the invention composite fiber of Example 1 (and also of a ruler to show scale).

As used herein, "a," "an," "the," "at least one," and "one or more" are used interchangeably. In any embodiment of the instant invention described herein, the open-ended terms "comprising," "comprises," and the like (which are synonymous with "including," "having," and "characterized by") may be replaced by the respective partially closed phrases "consisting essentially of," consists essentially of," and the like or the respective closed phrases "consisting of," "consists of," and the like. In the present application, when referring to a preceding list of elements (e.g., ingredients), the phrases "mixture thereof," "combination thereof," and the like mean any two or more, including all, of the listed elements.

For purposes of United States patent practice and other patent practices allowing incorporation of subject matter by reference, the entire contents—unless otherwise indicated—of each U.S. patent, U.S. patent application, U.S. patent application publication, PCT international patent application and WO publication equivalent thereof, referenced in the instant Detailed Description of the Invention are hereby incorporated by reference. In an event where there is a conflict between what is written in the present specification and what is written in a patent, patent application, or patent application publication, or a portion thereof that is incorporated by reference, what is written in the present specification controls. The present specification may be subsequently amended to incorporate by reference subject matter from a U.S. patent or U.S. patent application publication, or portion thereof, instead of from a PCT international patent application or WO publication equivalent, or portion thereof, originally referenced herein, provided that no new matter is added and the U.S. patent or U.S. patent application publication claims priority directly from the PCT international patent application.

In the present application, headings (e.g., "Definitions") are used for convenience and are not meant, and should not be used, to limit scope of the present disclosure in any way.

In the present application, any lower limit of a range of numbers, or any preferred lower limit of the range, may be combined with any upper limit of the range, or any preferred upper limit of the range, to define a preferred embodiment of the range. Each range of numbers includes all numbers subsumed within that range (e.g., the range from about 1 to about 5 includes, for example, 1, 1.5, 2, 2.75, 3, 3.80, 4, and 5).

In an event where there is a conflict between a unit value that is recited without parentheses, e.g., 2 inches, and a corresponding unit value that is parenthetically recited, e.g., (5 centimeters), the unit value recited without parentheses controls.

DEFINITIONS

As used herein, the terms "cation exchange capacity" and "cation exchanging capacity" of a cation exchanging layered material are synonymous and represent an amount of a set of exchangeable cations and describes a capability to replace one set of exchangeable cations (typically a capability to replace native inorganic ions such as sodium cation ($Na^+$), calcium cation ($Ca^{+2}$) or hydrogen cation ($H^+$)) with another set of cations, preferably active inorganic cations. Active inorganic cations are derived from an inorganic cation exchange material, which is described elsewhere herein. The term "exchangeable cations" means monovalent cations, polyvalent cations, or a mixture thereof, each cation having a formal positive charge.

The term "cation exchanging layered material" means a substance derived from a swellable (using the swelling liquid useful in the present invention) inorganic solid (natural or synthetic) comprised of negatively-charged layers (also known as sheets or platelets) and having a cation exchanging capacity (which is substantially exchangeable in a swollen state). Cations balance (i.e., neutralize) the negative charge of the cation exchanging layered material. The inorganic solid preferably is a swellable, natural or synthetic inorganic clay. The inorganic clay preferably comprises layers of negatively charged material and inorganic cations.

The term "cooled" includes being exposed to ambient conditions (i.e., room temperature and pressure) to passively lower temperature and being contacted with a means for cooling (e.g., a chamber heated to, or a stream of a gas at, temperature below temperature of a melt of a MSA material) to actively lower temperature.

The term "contacting under mixing conditions" preferably includes exfoliatably contacting under exfoliating conditions, described below, when the inorganic particulate comprises inorganic clay.

The term "desired amount" means a weight sufficient for producing an intended composite.

The term "dispersed" means distributed substantially evenly throughout a medium (e.g., a polymer).

The term "exfoliatably contacting" and phrase "under exfoliating conditions" are essentially synonymous and mean mixing an inorganic clay capable of being exfoliated in a medium under conditions facilitating mechanical separation (e.g., via shear) of at least some layers of the inorganic clay to produce a mixture, suspension, or distribution of an exfoliated inorganic clay, wherein the is distributed substantially evenly throughout the medium (e.g., a polymer).

The term "exfoliated" means, for present purposes, that the cation exchanging layered material is partially or fully delaminated such that at least 50% of particles thereof have at least one dimension that is less than 100 nm. Preferably, the cation exchanging layered material is delaminated into first components, each independently having one, two, three, four, five, six, seven, eight, nine, or ten layers of cation exchanging layered material and, optionally, second components, each independently having more than ten layers of cation exchanging layered material, the volume percent of all of the first components being greater than the volume percent of all of the second components upon examination by transmission electron microscopy of a representative sample of polymer composite. That is, the cation exchanging layered material need not be completely exfoliated into one-layer components, but may exist as a mixture of components having varying numbers of layers as described.

The term "fiber" means a fibril-, filament-, strand-, or thread-like structure. Preferably, the fiber has an aspect ratio of 10:1 or higher, preferably 100:1 or higher. In some embodiments, the fiber is continuous. In other embodiments, the fiber is discontinuous.

If necessary, average fiber diameter for a plurality of fibers is determined by processing a scanning electron microscopy image thereof with, for example, a QWin image analysis system (Leica Microsystems GmbH, 35578 Wezlar, Germany).

The term "finely-divided metal" means a charge-neutral particulate solid consisting essentially of (i.e., at least 95 percent by weight) one or more neutral elements of Groups 3 to 14 of the Periodic Table of the Elements and having an average diameter of from 1 μm to 1000 μm. Preferably, the finely-divided metal consists essentially of titanium (Ti), zirconium (Zr), chromium (Cr), molybdenum (Mo), tungsten (W), iron (Fe), ruthenium (Ru), cobalt (Co), rhodium (Rh), nickel (Ni), palladium (Pd), platinum (Pt), copper (Cu), silver (Ag), gold (Au), zinc (Zn), cadmium (Cd), aluminum (Al), gallium (Ga), carbon (C), silicon (Si), germanium (Ge), tin (Sn), lead (Pb), or an alloy of two or more thereof. More preferably, the finely-divided metal consists essentially of Pd, Pt, Cu, Ag, Au, or Zn. Still more preferably, the finely-divided metal consists essentially of Cu, Ag, Au, or Zn.

The phrase "having at least two dimensions" means characterized by width and depth, and, optionally, length.

The term "inorganic cations" means native inorganic cations, active inorganic cations, or a mixture of native and active inorganic cations.

The term "inorganic cation material" means a substance comprising active inorganic cations and their associated counter anions. The term "active inorganic cation" means a cation of a metal of any one of Groups 3 to 12 of the Periodic Table of the Elements. The active inorganic cations may be the same or different.

The term "metal carbonate" means a formally charge-neutral organic particulate consisting of carbonate (i.e., $CO_3^{-2}$) or bicarbonate (i.e., $HCO_3^{-1}$) and one or more cationic elements of any one of Groups 3 to 14 of the Periodic Table of the Elements. Preferred metal carbonates are sodium carbonate, sodium bicarbonate, lithium carbonate, lithium bicarbonate, potassium carbonate, potassium bicarbonate, magnesium carbonate, and calcium carbonate. More preferred organic particulates are sodium carbonate, sodium bicarbonate, and potassium bicarbonate.

The term "metal hydroxide" means a formally charge-neutral particulate consisting of at least one hydroxide moiety (i.e., $HO^-$) and one or more cationic elements of any one of Groups 3 to 14 of the periodic table of the chemical elements. Preferred metal hydroxides are barium hydroxide, cobalt hydroxide, copper hydroxide, sodium hydroxide, lithium hydroxide, potassium hydroxide, magnesium hydroxide, and calcium hydroxide. More preferred metal hydroxide particulates are magnesium hydroxide, and calcium hydroxide.

The term "metal oxide" means a formally charge-neutral inorganic particulate consisting of at least one oxide moiety (i.e., $O^{2-}$) and one or more cationic elements of any one of Groups 3 to 14 of the Periodic Table of the Elements. Preferred metal oxides are aluminum oxide, silicon dioxide, titanium dioxide, and zinc oxide. Another preferred metal oxide is a mixed metal oxide such as, for example, barium titanate. More preferred metal oxides are titanium dioxide and zinc oxide.

Particle size analysis methods and instruments are well known to the skilled person in the art. Preferably, particle size is determined using a Beckman Coulter RAPIDVUE™ instrument (Beckman Coulter Particle Characterization, Miami, Fla., USA). The particle size distribution is not critical and in some embodiments is characterized as being monodispersed, Gaussian, or random.

The term "native inorganic cation" means a cation of a metal from any one of groups 1, 2, 13, and 14 of the Periodic Table of the Elements. More preferred are lithium cation (Li+), sodium cation (Na+), and potassium cation (K+). Other native inorganic cations include magnesium cation (Mg2+), calcium cation (Ca2+), and a silicon atom having a formal charge of +4.

The term "non-MSA polymer" means an oligomeric or polymeric organic substance that is not a macromolecularly self-assembling material. Preferred non-MSA polymer fiber comprises a polyamide (e.g., a nylon), polyester (e.g., polyethylene terephthalate (PET) and polybutylene terephthalate (PBT)), phenol-formaldehyde, polyvinyl alcohol, polyvinyl chloride, polyolefin (e.g., polypropylene and polyethylene), polyacrylonitrile, aromatic polyamids (aramids; e.g., TWARON™ (Enka B.V. LLC, Netherlands), KEVLAR™ and NOMEX™ (both E. I. DuPont de Nemours and Company)), or polyurethane. In some embodiments, the non-MSA polymer is obtained from a commercial supplier such as, for example, The Dow Chemical Company, Midland, Mich., USA.

Unless otherwise noted, the phrase "Periodic Table of the Elements" refers to the periodic table, version dated Jun. 22, 2007, published by the International Union of Pure and Applied Chemistry (IUPAC).

The term "silicate mineral" means a material containing a structural unit, $SiO_4$. Preferred silicate minerals are neosilicates (e.g., titanite ($CaTiSiO_5$)), sorosilicates (e.g., lawsonite), cyclosilicates (e.g., benitoite), inosilicates (e.g., wollastonite and anthophyllite), phyllosilicates (e.g., talc and kaolinite), and tectosilicates (e.g., quartz and natrolite).

The term "$T_g$" means glass transition temperature as determined by differential scanning calorimetry (DSC).

The term "$T_m$" means melting temperature as determined by DSC. If a MSA material has one or more $T_m$, preferably at least one $T_m$ is 25° C. or higher.

For purposes herein, determine $T_g$ and $T_m$ according to the following procedure. Load a sample weighing between 5 milligrams (mg) and 10 mg into an aluminum hermetic DSC pan. Sequentially expose the sample to a first heating scan, holding step, cooling step, and a second heating scan. Particularly, in the first heating scan, heat the sample to 200° C. at a heating rate of 10° C. per minute. Hold the sample at 200° C. for 1 minute, and then cool the sample to −80° C. at a cooling rate of 10° C. per minute. Then in the second heating scan, heat the cooled sample to 200° C. at a heating rate of 10° C. per minute. Determine thermal events such as $T_g$ and $T_m$ from the second heating scan.

The term "viscosity" means zero shear viscosity unless specified otherwise.

Unless otherwise indicated, each "weight percent" of a component of a multicomponent material is determined by dividing weight of the component by total weight of the multicomponent material, and multiplying the result by 100.

Inorganic Clays

In some embodiments, the inorganic cations consist essentially of native inorganic cations, that is the cation exchanging capacity is 0 mole percent (mol %) exchanged (i.e., not exchanged) with the active inorganic cations. In other embodiments, the inorganic cations consist essentially of active inorganic cations, that is to say the cation exchanging capacity is 100 mol % or more exchanged with the active inorganic cations. In still other embodiments, the inorganic cations consist essentially of the mixture of native and active inorganic cations, that is to say the cation exchanging capacity is from greater than 0 mol % to less than 100 mol % exchanged, preferably from 20 mol % to 99 mol % exchanged, with the active inorganic cations. Preferably the cation exchanging capacity is at least 20 mol % exchanged, more preferably at least 50 mol % exchanged, still more preferably at least 75 mol % exchanged, and even more preferably at least 100 mol % exchanged with the active inorganic cations and, the remainder of the cation exchanging capacity being the unexchanged native inorganic cations.

In other embodiments, the cation exchanging capacity of the inorganic clay is more than 100 mol % exchanged with the active inorganic cations. That is, all of the charge-neutralizing native inorganic cations and at least some additional native inorganic cations have been exchanged for active inorganic cations. In such embodiments, the inorganic clay lacks native inorganic cations.

Native inorganic cations of the inorganic clay may be exchanged for active inorganic cations by contacting the inorganic clay having native inorganic cations with a solution comprising the active inorganic cations and an ion exchange solvent. A preferred ion exchange solvent is water, methanol, acetone, formic acid, or a mixture of two or more thereof. More preferred is water.

In some embodiments, a first polymer inorganic clay composite, or a first polymer inorganic clay composite fiber extruded therefrom, comprises native inorganic cations, and the process of the second embodiment further comprises steps of: contacting the first polymer inorganic clay composite, or fiber extruded therefrom, with an inorganic cation exchange material comprising active inorganic cations; and exchanging at least some of the native cations of the first polymer inorganic clay composite for at least some of the active inorganic cations of the inorganic cation exchange material to produce a second polymer inorganic clay composite or fiber extruded therefrom, wherein the second polymer inorganic clay composite, or fiber extruded therefrom, comprises active inorganic cations.

The cation exchange capacity of the inorganic clay may be measured by several methods, most of which perform an actual exchange reaction and analyze the product for the presence of each of the exchanging ions. Thus, the stoichiometry of exchange preferably is determined on a mole percent (mol %) basis. Preferably, the cation exchange capacities of commercially available inorganic clays are provided by commercial suppliers of the inorganic clays.

While the particular method used to measure the cation exchange capacity of the inorganic clay is not important to the present invention, preferably, the cation exchange capacity of the inorganic clay may be measured using the procedure described on page 155 of *Composition and Properties of Oil Well Drilling Fluids,* $4^{th}$ edition, George R. Gray and H. C. H. Darley, 1980, Gulf Publish Company, Houston, Tex., USA. One method of Gray and Darley involves leaching a first sample of an inorganic clay with excess of a suitable salt such as, for example, ammonium acetate to provide a first filtrate and leaching a second sample of the inorganic clay with water to provide a second filtrate. Separately analyzing the first and second filtrates for common exchange cations by conventional means provides a milliequivalents (mEQ, defined below) of each species of cation adsorbed on the clay and, thus, total mEQ, i.e., cation exchange capacity (CEC), of all species of cations. The term "milliequivalents" (mEQ) equals millimole equivalents of cation exchange capacity; for example, 125 mEQ means 0.125 moles of cation exchange capacity.

The inorganic clay (i.e., inorganic cation exchanging layered material) useful in the present invention (e.g., a silicate clay or 2:1 silicate clay in its natural state or washed with purified water) preferably has a negative charge on its surface of at least 20 mEQ, more preferably at least 50 mEQ, and preferably 200 mEQ or less, more preferably 150 mEQ or less, still more preferably 125 mEQ or less, per 100 grams (g) of the material.

Preferably, the inorganic clay is a natural inorganic clay (consisting essentially of native inorganic cations), more preferably a natural layered silicate (such as a kenyaite), layered 2:1 silicate (such as a natural smectite, hormite, vermiculite, illite, mica, and chlorite), or sepiolite, or the inorganic clay is derived by exchanging at least some of the native inorganic cations of the natural inorganic clay for active inorganic cations. Examples of preferred inorganic clays are layered silicates (such as kenyaite), layered 2:1 silicates (such as natural and synthetic smectites, hormites, vermiculites, illites, micas, and chlorites), and sepiolites. Preferably, the cation exchanging layered material is derived from a natural montmorillonite, mica, fluoromica, sepiolite, nontronite, bentonite, kaolinite, beidellite, volkonskonite, hectorite, fluorohectorite, saponite, sauconite, stevensite, halloysite, medmontite, kenyaite, or vermiculite, or a mixture of two or more thereof. More preferably, the cation exchanging layered material is derived from a natural mica, fluoromica, montmorillonite, or sepiolite. In some embodiments, the cation exchanging layered material is not derived from magadiite or a synthetic hydrous magnesium silicate clay (e.g., LAPONITE®, Rockwood Additives Limited, Cheshire, England). Preferably, the synthetic inorganic clay is a synthetic mica (such as, for example, SOMASIF ME-100, Co-Op Chemicals, Japan) or montmorillonite (e.g., CLOISITE™ $Na^+$, Southern Clay Products, Inc., USA).

Molecularly Self-Assembling Material

As used herein a MSA material means an oligomer or polymer that effectively forms larger associated or assembled oligomers and/or polymers through the physical intermolecular associations of chemical functional groups. Without wishing to be bound by theory, it is believed that the intermolecular associations do not increase the molecular weight (Mn-Number Average molecular weight) or chain length of the self-assembling material and covalent bonds between said materials do not form. This combining or assembling occurs spontaneously upon a triggering event such as cooling to form the larger associated or assembled oligomer or polymer structures. Examples of other triggering events are the shear-induced crystallizing of, and contacting a nucleating agent to, a molecularly self-assembling material. Accordingly, in preferred embodiments MSAs exhibit mechanical properties similar to some higher molecular weight synthetic polymers and viscosities like very low molecular weight compounds. MSA organization (self-assembly) is caused by non-covalent bonding interactions, often directional, between molecular functional groups or moieties located on individual molecular (i.e. oligomer or polymer) repeat units (e.g. hydrogen-bonded arrays). Non-covalent bonding interactions include: electrostatic interactions (ion-ion, ion-dipole or dipole-dipole), coordinative metal-ligand bonding, hydrogen bonding, π-π-structure stacking interactions, donor-acceptor, and/or van der Waals forces and can occur intra- and intermolecularly to impart structural order. One preferred mode of self-assembly is hydrogen-bonding and this non-covalent bonding interactions is defined by a mathematical "Association constant", K (assoc) constant describing the relative energetic interaction strength of a chemical complex or group of complexes having multiple hydrogen bonds. Such complexes give rise to the higher-ordered structures in a mass of MSA materials. A description of self assembling multiple H-bonding arrays can be found in "Supramolecular Polymers", Alberto Ciferri Ed., 2nd Edition, pages (pp) 157-158. A "hydrogen bonding array" is a purposely synthesized set (or group) of chemical moieties (e.g. carbonyl, amine, amide, hydroxyl. etc.) covalently bonded on repeating structures or units to prepare a self assembling molecule so that the individual chemical moieties preferably form self assembling donor-acceptor pairs with other donors and acceptors on the same, or different, molecule. A "hydrogen bonded complex" is a chemical complex formed between hydrogen bonding arrays. Hydrogen bonded arrays can have association constants K (assoc) between $10^2$ and $10^9$ $M^{-1}$ (reciprocal molarities), generally greater than $10^3$ $M^{-1}$. In preferred embodiments, the arrays are chemically the same or different and form complexes.

Accordingly, the molecularly self-assembling materials (MSA) presently include: molecularly self-assembling polyesteramides, copolyesteramide, copolyetheramide, copolyetherester-amide, copolyetherester-urethane, copolyether-urethane, copolyester-urethane, copolyester-urea, copolyetherester-urea and their mixtures. Preferred MSA include copolyesteramide, copolyether-amide, copolyester-urethane, and copolyether-urethanes. The MSA preferably has number average molecular weights, $MW_n$ (interchangeably referred to as $M_n$) (as is preferably determined by NMR spectroscopy) of 2000 grams per mole or more, more preferably at least about 3000 g/mol, and even more preferably at least about 5000 g/mol. The MSA preferably has $MW_n$ 50,000 g/mol or less, more preferably about 20,000 g/mol or less, yet more preferably about 15,000 g/mol or less, and even more preferably about 12,000 g/mol or less. The MSA material preferably comprises molecularly self-assembling repeat units, more preferably comprising (multiple) hydrogen bonding arrays, wherein the arrays have an association constant K (assoc) preferably from $10^2$ to $10^9$ reciprocal molarity ($M^{-1}$) and still more preferably greater than $10^3$ $M^{-1}$; association of multiple-hydrogen-bonding arrays comprising donor-acceptor hydrogen bonding moieties is the preferred mode of self assembly. The multiple H-bonding arrays preferably comprise an average of 2 to 8, more preferably 4-6, and still more preferably at least 4 donor-acceptor hydrogen bonding moieties per molecularly self-assembling unit. Molecularly self-assembling units in preferred MSA materials include bis-amide groups, and bis-urethane group repeat units and their higher oligomers.

Preferred self-assembling units in the MSA material useful in the present invention are bis-amides, bis-urethanes and bis-urea units or their higher oligomers. A more preferred self-assembling unit comprises a poly(ester-amide), poly (ether-amide), poly(ester-urea), poly(ether-urea), poly(ester-urethane), or poly(ether-urethane), or a mixture thereof. For convenience and unless stated otherwise, oligomers or polymers comprising the MSA materials may simply be referred to herein as polymers, which includes homopolymers and interpolymers such as co-polymers, terpolymers, etc.

In some embodiments, the MSA materials include "non-aromatic hydrocarbylene groups" and this term means specifically herein hydrocarbylene groups (a divalent radical formed by removing two hydrogen atoms from a hydrocarbon) not having or including any aromatic structures such as aromatic rings (e.g. phenyl) in the backbone of the oligomer or polymer repeating units. In some embodiments, non-aromatic hydrocarbylene groups are optionally substituted with various substituents, or functional groups, including but not limited to: halides, alkoxy groups, hydroxy groups, thiol groups, ester groups, ketone groups, carboxylic acid groups, amines, and amides. A "non-aromatic heterohydrocarbylene" is a hydrocarbylene that includes at least one non-carbon atom (e.g. N, O, S, P or other heteroatom) in the backbone of the polymer or oligomer chain, and that does not have or include aromatic structures (e.g., aromatic rings) in the backbone of the polymer or oligomer chain. In some embodiments, non-aromatic heterohydrocarbylene groups are optionally substituted with various substituents, or functional groups, including but not limited to: halides, alkoxy groups, hydroxy groups, thiol groups, ester groups, ketone groups, carboxylic acid groups, amines, and amides. Heteroalkylene is an alkylene group having at least one non-carbon atom (e.g. N, O, S or other heteroatom) that, in some embodiments, is optionally substituted with various substituents, or functional groups, including but not limited to: halides, alkoxy groups, hydroxy groups, thiol groups, ester groups, ketone groups, carboxylic acid groups, amines, and amides. For the purpose of this disclosure, a "cycloalkyl" group is a saturated carbocyclic radical having three to twelve carbon atoms, preferably three to seven. A "cycloalkylene" group is an unsaturated carbocyclic radical having three to twelve carbon atoms, preferably three to seven. Cycloalkyl and cycloalkylene groups independently are monocyclic or polycyclic fused systems as long as no aromatics are included. Examples of carbocyclic radicals include cyclopropyl, cyclobutyl, cyclopentyl, cyclohexyl and cycloheptyl. In some embodiments, the groups herein are optionally substituted in one or more substitutable positions as would be known in the art. For example in some embodiments, cycloalkyl and cycloalkylene groups are optionally substituted with, among others, halides, alkoxy groups, hydroxy groups, thiol groups, ester groups, ketone groups, carboxylic acid groups, amines, and amides. In some embodiments, cycloalkyl and cycloalkene groups are optionally incorporated into combinations with other groups to form additional substituent groups, for example: "-Alkylene-cycloalkylene-, "-alkylene-cycloalkylene-alkylene-", "-heteroalkylene-cycloalkylene-", and "-heteroalkylene-cycloalkyl-heteroalkylene" which refer to various non-limiting combinations of alkyl, heteroalkyl, and cycloalkyl. These combinations include groups such as oxydialkylenes (e.g., diethylene glycol), groups derived from branched diols such as neopentyl glycol or derived from cyclo-hydrocarbylene diols such as Dow Chemical's UNOXOL® isomer mixture of 1,3- and 1,4-cyclohexanedimethanol, and other non-limiting groups, such -methylcylohexyl-, -methyl-cyclohexyl-methyl-, and the like. "Heterocycloalkyl" is one or more cyclic ring systems having 4 to 12 atoms and, containing carbon atoms and at least one and up to four heteroatoms selected from nitrogen, oxygen, or sulfur. Heterocycloalkyl includes fused ring structures. Preferred heterocyclic groups contain two ring nitrogen atoms, such as piperazinyl. In some embodiments, the heterocycloalkyl groups herein are optionally substituted in one or more substitutable positions. For example in some embodiments, heterocycloalkyl groups are optionally substituted with halides, alkoxy groups, hydroxy groups, thiol groups, ester groups, ketone groups, carboxylic acid groups, amines, and amides.

Examples of MSA materials useful in the present invention are poly(ester-amides), poly(ether-amides), poly(ester-ureas), poly(ether-ureas), poly(ester-urethanes), and poly (ether-urethanes), and mixtures thereof that are described, with preparations thereof, in U.S. Pat. No. 6,172,167; and applicant's co-pending PCT application numbers PCT/US2006/023450, which was renumbered as PCT/US2006/004005 and published under PCT International Patent Application Number (PCT-IPAPN) WO 2007/099397 and U.S. Patent Application Publication Number (USPAPN) 2008-0214743; PCT/US2006/035201, which published under PCT-IPAPN WO 2007/030791; PCT/US08/053917, which published under PCT-IPAPN WO 2008/101051; PCT/US08/056754, which published under PCT-IPAPN WO 2008/112833; and PCT/US08/065242. Preferred said MSA materials are described below.

In a set of preferred embodiments, the molecularly self-assembling material comprises ester repeat units of Formula I:

Formula I

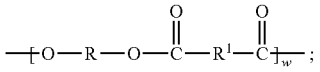

and at least one second repeat unit selected from the esteramide units of Formula II and III:

Formula II

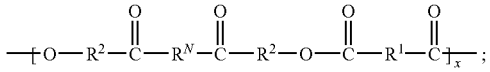

Formula III

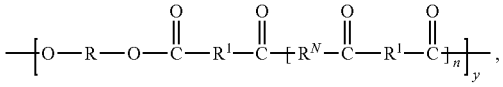

and the ester-urethane units of Formula IV:

Formula IV

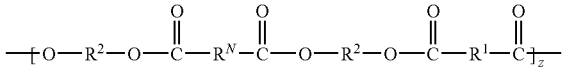

wherein

R is at each occurrence, independently a $C_2$-$C_{20}$ non-aromatic hydrocarbylene group, a $C_2$-$C_{20}$ non-aromatic heterohydrocarbylene group, or a polyalkylene oxide group having a group molecular weight of from about 100 to about 5000 g/mol. In preferred embodiments, the $C_2$-$C_{20}$ non-aromatic hydrocarbylene at each occurrence is independently specific groups: alkylene-, -cycloalkylene-, -alkylene-cycloalkylene-, -alkylene-cycloalkylene-alkylene- (including dimethylene cyclohexyl groups). Preferably, these aforementioned specific groups are from 2 to 12 carbon atoms, more preferably from 3 to 7 carbon atoms. The $C_2$-$C_{20}$ non-aromatic heterohydrocarbylene groups are at each occurrence, independently specifically groups, non-limiting examples including: -hetereoalkylene-, -heteroalkylene-cycloalkylene-, -cycloalkylene-heteroalkylene-, or -heteroalkylene-cycloalkylene-heteroalkylene-, each aforementioned specific group preferably comprising from 2 to 12 carbon atoms, more preferably from 3 to 7 carbon atoms. Preferred heteroalkylene groups include oxydialkylenes, for example diethylene glycol (—$CH_2CH_2OCH_2CH_2$—O—). When R is a polyalkylene oxide group it preferably is a polytetramethylene ether, polypropylene oxide, polyethylene oxide, or their combinations in random or block configuration wherein the molecular weight (Mn-average molecular weight, or conventional molecular weight) is preferably about 250 g/ml to 5000, g/mol, more preferably more than 280 g/mol, and still more preferably more than 500 g/mol, and is preferably less than 3000 g/mol; in some embodiments, mixed length alkylene oxides are included. Other preferred embodiments include species where R is the same $C_2$-$C_6$ alkylene group at each occurrence, and most preferably it is —$(CH_2)_4$—.

$R^1$ is at each occurrence, independently, a bond, or a $C_1$-$C_{20}$ non-aromatic hydrocarbylene group. In some preferred embodiments, $R^1$ is the same $C_1$-$C_6$ alkylene group at each occurrence, most preferably —$(CH_2)_4$—.

$R^2$ is at each occurrence, independently, a $C_1$-$C_{20}$ non-aromatic hydrocarbylene group. According to another embodiment, $R^2$ is the same at each occurrence, preferably $C_1$-$C_6$ alkylene, and even more preferably $R^2$ is —$(CH_2)_2$—, —$(CH_2)_3$—, —$(CH_2)_4$—, or —$(CH_2)_5$—.

$R^N$ is at each occurrence —$N(R^3)$—Ra—$N(R^3)$—, where $R^3$ is independently H or a $C_1$-$C_6$ alkyl, preferably $C_1$-$C_4$ alkyl, or $R^N$ is a $C_2$-$C_{20}$ heterocycloalkylene group containing the two nitrogen atoms, wherein each nitrogen atom is bonded to a carbonyl group according to Formula II or III above; w represents the ester mol fraction, and x, y and z represent the amide or urethane mole fractions where $w+x+y+z=1$, $0<w<1$, and at least one of x, y and z is greater than zero. Ra is a $C_2$-$C_{20}$ non-aromatic hydrocarbylene group, more preferably a $C_2$-$C_{12}$ alkylene: most preferred Ra groups are ethylene butylene, and hexylene —$(CH_2)_6$—. In some embodiments, $R^N$ is piperazin-1,4-diyl. According to another embodiment, both $R^3$ groups are hydrogen.

n is at least 1 and has a mean value less than 2.

In an alternative embodiment, the MSA is a polymer consisting of repeat units of either Formula II or Formula III, wherein R, $R^1$, $R^2$, $R^N$, and n are as defined above and x and y are mole fractions wherein $x+y=1$, and $0\leq x\leq 1$ and $0\leq y\leq 1$.

In certain embodiments comprising polyesteramides of Formula I and II, or Formula I, II, and III, particularly preferred materials are those wherein R is —($C_2$-$C_6$)— alkylene, especially —$(CH_2)_4$—. Also preferred are materials wherein $R^1$ at each occurrence is the same and is $C_1$-$C_6$ alkylene, especially —$(CH_2)_4$—. Further preferred are materials wherein $R^2$ at each occurrence is the same and is —($C_1$-$C_6$)— alkylene, especially —$(CH_2)_5$— alkylene. The polyesteramide according to this embodiment preferably has a number average molecular weight (Mn) of at least about 4000, and no more than about 20,000. More preferably, the molecular weight is no more than about 12,000.

For convenience the chemical repeat units for various embodiments are shown independently. The invention encompasses all possible distributions of the w, x, y, and z units in the copolymers, including randomly distributed w, x, y and z units, alternatingly distributed w, x, y and z units, as well as partially, and block or segmented copolymers, the definition of these kinds of copolymers being used in the conventional manner as known in the art. Additionally, there are no particular limitations in the invention on the fraction of the various units, provided that the copolymer contains at least one w and at least one x, y, or z unit. In some embodiments, the mole fraction of w to (x+y+z) units is between about 0.1:0.9 and about 0.9:0.1. In some preferred embodiments, the copolymer comprises at least 15 mole percent w units, at least 25 mole percent w units, or at least 50 mole percent w units In some embodiments, the number average molecular weight ($M_n$) of the MSA material useful in the present invention is between 1000 g/mol and 30,000 g/mol, inclusive. In some embodiments, $M_n$ of the MSA material is between 2,000 g/mol and 20,000 g/mol, inclusive, preferably 5,000 g/mol to 12,000 g/mol. In more preferred embodiments, $M_n$ of the MSA material is less than 5,000 g/mol. Thus, in some more preferred embodiments, $M_n$ of the MSA material is at least about 1000 g/mol and 4,900 g/mol or less, more preferably 4,500 g/mol or less.

Viscosity of a melt of a preferred MSA material (neat) is characterized as being Newtonian over the frequency range of $10^{-1}$ to $10^2$ radians per second (rad./s.) at a temperature from above a melting temperature $T_m$ up to about 40 degrees Celsius (° C.) above $T_m$, preferably as determined by differential scanning calorimetry (DSC). Depending upon the polymer or oligomer, preferred MSA materials exhibit Newtonian viscosity in the test range frequency at temperatures above 100° C., more preferably above 120° C. and more preferably still at or above 140° C. and preferably less than 300° C., more preferably less than 250° C. and more preferably still less than 200° C. For the purposes of the present disclosure, the term Newtonian has its conventional meaning; that is, approximately a constant viscosity with increasing (or decreasing) shear rate of a (MSA) material at a constant testing temperature. The zero shear viscosity of a preferred MSA material is in the range of from 0.1 Pa.s. to 1000 Pa.s., preferably from 0.1 Pa.s. to 100 Pa.s., more preferably from 0.1 to 30 Pa.s., still more preferred 0.1 Pa.s. to 10 Pa.s., between the temperature range of 180° C. and 220° C., e.g., 180° C. and 190° C.

Preferably, the viscosity of a melt of a MSA material useful in the present invention is less than 100 Pa.s. at from above $T_m$ up to about 40° C. above $T_m$. The viscosity of one of the preferred MSA materials is less than 100 Pa.s. at 190° C., and more preferably in the range of from 1 Pa.s. to 50 Pa.s. at 150° C. to 170° C. Preferably, the glass transition temperature of the MSA material is less than 20° C. Preferably, the melting temperature is higher than 60° C. Preferred MSA materials exhibit multiple glass transition temperatures $T_g$. Preferably, the MSA material has a $T_g$ that is higher than −80° C. Also preferably, the MSA material has a $T_g$ that is higher than −60° C.

Tensile modulus of one preferred group of MSA materials is preferably from 4 megapascals (MPa) to 500 MPa at room temperature, preferably 20° C. Tensile modulus testing is well known in the polymer arts.

Preferably, torsional (dynamic) storage modulus of MSA materials useful in the invention is at least 100 MPa at 20° C. More preferably, the storage modulus is at least 200 MPa, still more preferably at least 300 MPa, and even more preferably greater than 400 MPa, all at 20° C.

Preferably, polydispersities of substantially linear MSA materials useful in the present invention is 4 or less, more preferably 3 or less, still more preferably 2.5 or less, still more preferably 2.2 or less.

In some embodiments, the polymers described herein are modified with, for example and without limitation thereto, other polymers, resins, tackifiers, fillers, oils and additives (e.g. flame retardants, antioxidants, pigments, dyes, and the like).

The Polymer Inorganic-Particulate Composite

A preferred polymer inorganic-particulate composite is characterized, when a melt, as having a zero shear viscosity of less than 10,000,000 Pa.s., more preferably 1,000,000 Pa.s. or less at from above $T_m$ up to about 40° C. above $T_m$. The viscosity of a melt of one of the preferred MSA materials is less than 200 Pa.s. at 180° C., and more preferably in the range of from about 2 Pa.s. to about 100,000 Pa.s., more preferably from 1 Pa.s. to 100 Pa.s. at 150° C. to 170° C.

Another preferred polymer inorganic-particulate composite is characterized as having a storage modulus (G') compared to G' of the MSA material alone (i.e., unfilled), of 2 times or higher, more preferably 3 times or higher, and still more preferably 6 times or higher, all at 25° C. In some embodiments, G' of the polymer inorganic-particulate composite is 200 megaPascals (MPa) or higher than G' of the MSA material alone. In other embodiments, G' of the polymer inorganic-particulate composite is 400 MPa or higher, more preferably 600 MPa or higher, and still more preferably 1,000 MPa or higher, all at 25° C. Storage modulus G' is measured by dynamic mechanical spectroscopy (DMS) according to the method described later.

The Process of Making the Invention Polymer Inorganic-Particulate Composite

In some embodiments, the MSA material and inorganic particulate are contacted or, with inorganic clay exfoliatably contacted (e.g., compounded or blended under shear), at a temperature of 30° C. or higher and 350° C. or less, provided the temperature is above the MSA material's glass transition temperature ($T_g$) or melt temperature ($T_m$), whichever is higher. In some embodiments, the MSA material and inorganic particulate are compounded at a pressure of 0.1 atmosphere (ATM) to 1000 ATM.

Preferably, temperature of the melt comprising the MSA material during the contacting with (dispersing of) inorganic particulate therein is less than 250° C., more preferably less than 200° C., and still more preferably less than 180° C.

The relatively low temperature of the melt comprising the MSA material and relatively low shear stress during the contacting (e.g., mixing) or exfoliatably contacting (e.g., mixing and delaminating) of inorganic particulate thereto as compared to, for example, the temperature of, and shear stress during (exfoliatably) contacting, a comparator melt comprising a conventional thermoplastic polymer to the inorganic particulate, is preferred for MSA materials having the zero shear viscosities described previously (e.g., preferably in the range of from 1 Pa.s. to 50 Pa.s. at 150° C. to 170° C.).

In some embodiments, the melt or solution comprising a MSA material comprises one MSA material. In other embodiments, the melt or solution comprises a mixture of two or more different MSA materials.

The Polymer Inorganic-Particulate Composite Fiber

Preferably, the inorganic clay or metal hydroxide comprises a total of at least 2 wt %, more preferably at least 10 wt %, still more preferably at least 20 wt %, and even more preferably at least 30 wt % of the polymer inorganic-particulate composite fiber of the first embodiment based on total weight of the polymer inorganic-particulate composite fiber. Also preferably, the inorganic clay or metal hydroxide comprises a total of about 80 wt % or less, more preferably about 70 wt % or less, still more preferably about 60 wt % or less, and even more preferably about 50 wt % or less of the polymer inorganic-particulate composite fiber of the first embodiment based on total weight of the polymer inorganic-particulate composite fiber.

Process of Making the Polymer Inorganic-Particulate Composite Fiber

Referring to the process of the second embodiment, preferably, the mixture is prepared by a process comprising a step of: heating a polymer inorganic-particulate composite comprising the inorganic particulate and the MSA material to give the mixture comprising the inorganic particulate and a second melt comprising the MSA material. Preferably, the polymer inorganic-particulate composite is made by a process comprising a step of: contacting under mixing conditions a desired amount of the inorganic particulate to either a third melt of the MSA material or a solution comprising a solvent and the MSA material to produce the polymer inorganic-particulate composite. In some embodiments, the contacting step comprises exfoliatably contacting under mixing and exfoliating conditions. Preferably the contacting step employs the third melt of the MSA material. Temperature of the third melt comprising the MSA material in the contacting step, temperature of the second melt comprising the MSA material in the heating step, and temperature of the first melt comprising the MSA material in the mixture in the extruding step independently are the same or different.

In some embodiments, the polymer inorganic-particulate composite produced in the contacting step is used in the extruding step without being isolated or cooled to room temperature (i.e., 25 degrees Celsius (° C.)) beforehand. In other embodiments, the polymer inorganic-particulate composite produced in the contacting step is isolated and cooled (e.g., to room temperature), and the resulting cooled polymer inorganic-particulate composite is then used in the heating step.

In some embodiments, the polymer inorganic-particulate composite fiber of the first embodiment further comprises a supplemental MSA material or non-MSA polymer. In some embodiments, the process of the second embodiment further comprises, before the extruding step, a step comprising contacting under mixing conditions the supplemental MSA material or non-MSA polymer to the mixture comprising the first or second inorganic particulate and the second melt comprising the MSA material to respectively give the polymer inorganic-particulate composite fiber of the first embodiment further comprising the supplemental MSA material or non-MSA polymer. The MSA material and supplemental MSA material may be the same or different. In some embodiments, the contacting step comprises exfoliatably contacting under exfoliating conditions.

The parameters for operating an extruder for effective melt spinning extrusion of the polymer inorganic-particulate composite useful in the present invention may be readily determined by a person of ordinary skill in the art without undue experimentation. A typical melt spinning extrusion process for fabricating the polymer organoclay composite fiber is performed on a Werner & Pfleiderer ZSK-25-4 extruder. Parameters for operating the extruder for effective melt spinning extrusion of the polymer organoclay composite fiber may be readily determined by a person of ordinary skill in the art without undue experimentation. By way of example, the barrel zone (Z1 to Z10) temperature set points are chosen as 50° C. (Z1) to 110 (Z10) ° C., die temperature of about 140° C. or higher (the die temperature typically exceeds $T_g$ or $T_m$, whichever is higher, of the MSA material). Adjust temperatures and screw speeds for melt viscosity of the particular MSA material being used. Use of commercially available plastic extruders such as manufactured by Werner & Pfleiderer, Battenfeld, Collin, Reifenhauser is more preferred.

Melt spun extruded polymer organoclay composite fibers of the present invention typically have an average diameter of from about 100 micrometers (μm) to about 1000 μm (i.e., 1 millimeter (mm)). In some embodiments, the melt spun extruded fibers have an average diameter of from about 5 μm to about 500 μm (i.e., from about 0.005 mm to about 0.5 mm) Melt spun extruded fibers that are further subjected to stretching produce drawn fibers having an average diameter of from about 10 μm to about 500 μm.

A melt spinning extrusion process described above preferably produces the polymer inorganic-particulate composite fiber without defects such as bubbles or fractures.

Materials and Methods

Materials

CLOISITE™ $Na^+$ (Southern Clay Products, Inc.) is a natural sodium montmorillonite inorganic clay having CAS No. 1318-93-0. CLOISITE™ $Na^+$ is commercially obtained from Southern Clay Products, Inc., Gonzales, Tex., USA.

Magnesium hydroxide ($Mg(OH)_2$) is Dead Sea S-10 grade.

Procedure for Determining Number Average Molecular Weight ($M_n$) of a MSA Material by Nuclear Magnetic Resonance Spectroscopy Proton nuclear magnetic resonance spectroscopy (proton NMR or $^1$H-NMR) is used to determine monomer purity, copolymer composition, and copolymer number average molecular weight $M_n$ utilizing the $CH_2OH$ end groups. Proton NMR assignments are dependent on the specific structure being analyzed as well as the solvent, concentration, and temperatures utilized for measurement. For ester amide monomers and co-polyesteramides, d4-acetic acid is a convenient solvent and is the solvent used unless otherwise noted. For ester amide monomers of the type called DD that are methyl esters typical peak assignments are about 3.6 to 3.7 ppm for C(═O)—$OCH_3$; about 3.2 to 3.3 ppm for N—$CH_2$—; about 2.2 to 2.4 ppm for C(═O)—$CH_2$—; and about 1.2 to 1.7 ppm for C—$CH_2$—C. For co-polyesteramides that are based on DD with 1,4-butanediol, typical peak assignments are about 4.1 to 4.2 ppm for C(═O)—$OCH_2$—; about 3.2 to 3.4 ppm for N—$CH_2$—; about 2.2 to 2.5 ppm for C(═O)—$CH_2$—; about 1.2 to 1.8 ppm for C—$CH_2$—C, and about 3.6 to 3.75 —$CH_2OH$ end groups.

Compounding Procedures for Preparing Polymer Inorganic-Particulate Composites

Prior to compounding, all MSA materials and inorganic particulates are pre-weighed and stored separately. In the following procedure, the MSA materials and inorganic-particulates are not dried before blending.

Compounding Procedure 1: for use with any inorganic particulate described previously. A Haake PolyLab Rheocord blender (Haake) is outfitted with a 20 milliliter (mL) bowl. Temperatures of all zones of the Haake mixer are set to 160° C. An air cooling hose is attached to the central one of the zones in order to maintain temperature control. The MSA material is loaded into the 20 mL bowl and allowed to melt. Inorganic clay or other inorganic particulate is added directly to the MSA material melt. Then, a plunger is lowered into the Haake, and the melt of the MSA material with inorganic clay or other inorganic particulate (which typically do not melt) is compounded at a rotor speed of 200 revolutions per minute (rpm), and a residence time of approximately 2.5 minutes. The residence time begins with the lowering of the plunger, and ends with the raising the plunger. Table 1 presents the timing for the compounding.

TABLE 1

Summary of composite compounding procedure

| Time | rpm | Comment |
|---|---|---|
| 0 second | 200 | |
| 10 seconds | 50 | Add MSA material |
| 1 minute 10 seconds | 200 | Allow MSA material to melt |
| 1 minute 30 seconds | 200 | Add inorganic clay or other inorganic particulate |
| 2 minutes 30 seconds | 200 | Compound to give composite |
| 5 minutes | 0 | Recover composite |

Compounding Procedure 2: Preferred when inorganic particulate is a metal hydroxide such as, for example, $Mg(OH)_2$: The Haake is fitted with a 60 mL bowl and run at 170° C. and 50 rpm. The MSA material is added to the Haake bowl first and allowed to melt. Then the $Mg(OH)_2$ is added and blended into the MSA material for 10 minutes after all the $Mg(OH)_2$ is added. The resulting composites are removed from the Haake and pressed into flat pieces while still warm. After cooling at room temperature, the pressed composite material is cut into pieces for compression molding.

Compression Molding Procedures:

Prior to molding, all samples are allowed to dry overnight (at least 16 hours) at 65° C. in a vacuum of approximately 36 cmHg.

Compression Molding Procedure 1 (for the MSA material of Preparation 1C and the inorganic clay composites of Preparations 2-7): Samples are compression molded into 10 cm×10 cm×0.05 cm plaques and 5 cm×1.25 cm×0.32 cm bars using a MPT-14 compression/lamination press (Tetrahedron Associates, Inc., San Diego, Calif., USA). The molding parameters for composites comprising the MSA material of Preparation 1C are listed in Table 2.

TABLE 2

Summary of compression molding parameters for composites comprising the MSA material of Preparation 1C and the inorganic clay composites of Preparations 2-7

| Step | Temperature (° C.) | Temperature ramp rate (° C./minute) | Load, kg (klb) | Load ramp rate, kg/minute (klb/min) | Time (minutes) |
|---|---|---|---|---|---|
| 1 | 140 | 93 | 608 (1.5) | $317 \times 10^3$ (1200) | 5 |
| 2 | 140 | 93 | 4536 (10) | $317 \times 10^3$ (1200) | 4 |
| 3 | 140 | 93 | 18143 (40) | $317 \times 10^3$ (1200) | 3 |
| 4 | 37.8 | 93 | 450 (1) | $317 \times 10^3$ (1200) | 5 |
| 5 | End | | | | |

Compression Molding Procedure 2 (for Composite of Preparation 8):

Samples containing $Mg(OH)_2$ are compression molded into 5 cm by 5 cm by 0.3 cm plaques at 90° C. and 5000 psi. Cool composites under pressure in molder to room temperature or less to allow clean removal of the plaques from the mold chase.

Melt Viscosity Measurement Procedure

Samples are die cut from a plaque of composite. Parallel plate geometry holders in an Ares Rheometer (TA Instruments) are heated to 170° C. The holders are zeroed at temperature. A sample is loaded onto the holders, and the top holder is lowered into that sample so that there is significant normal force on the sample. The sample is allowed to melt, and any melted sample that extends beyond the holders is removed. Initially, a dynamic strain sweep is conducted at 1 Hz and 170° C. beginning at a strain of 0.1%. For each sample, a strain value is obtained from a region where dynamic loss shear modulus (G") is linear over a range of strain values. This strain value is used for subsequent dynamic frequency sweeps. Using the strain value obtained during the strain sweep, a frequency sweep is conducted at 170° C. The frequency ranged from 100 rad/s. to 0.1 rad/s. Plot results as viscosity in Pascal-seconds (Pa.s.) versus frequency in radians per second (rad/s.).

Preparations

Preparations 1A, 1B, and 1C: preparation of MSA material that is a polyesteramide (PEA) comprising 50 mole percent of ethylene-N,N'-dihydroxyhexanamide (C2C) monomer (the MSA material is generally designated as a PEA-C2C50%)

Step (a) Preparation of the diamide diol, ethylene-N,N'-dihydroxyhexanamide (C2C) monomer The C2C diamide diol monomer is prepared by reacting 1.2 kg ethylene diamine (EDA) with 4.56 kilograms (kg) of ϵ-caprolactone under a nitrogen blanket in a stainless steel reactor equipped with an agitator and a cooling water jacket. An exothermic condensation reaction between the ϵ-caprolactone and the EDA occurs which causes the temperature to rise gradually to 80 degrees Celsius (° C.). A white deposit forms and the reactor contents solidify, at which the stirring is stopped. The reactor contents are then cooled to 20° C. and are then allowed to rest for 15 hours. The reactor contents are then heated to 140° C. at which temperature the solidified reactor contents melt. The liquid product is then discharged from the reactor into a collecting tray. A nuclear magnetic resonance study of the resulting product shows that the molar concentration of C2C diamide diol in the product exceeds 80 percent. The melting temperature of the C2C diamide diol monomer product is 140° C.

Step (b): Contacting C2C with dimethyl adipate (DMA)

A 100 liter single shaft Kneader-Devolatizer reactor equipped with a distillation column and a vacuum pump system is nitrogen purged, and heated under nitrogen atmosphere to 80° C. (based on thermostat). Dimethyl adipate (DMA; 38.324 kg) and C2C diamide diol monomer (31.724 kg) are fed into the kneader. The slurry is stirred at 50 revolutions per minute (rpm).

Step (c): Contacting C2C/DMA with 1,4-butanediol, distilling methanol and transesterification 1,4-Butanediol (18.436 kg) is added to the slurry of Step (b) at a temperature of about 60° C. The reactor temperature is further increased to 145° C. to obtain a homogeneous solution. Still under nitrogen atmosphere, a solution of titanium(IV)butoxide (153 g) in 1.380 kg 1,4-butanediol is injected at a temperature of 145° C. into the reactor, and methanol evolution starts. The temperature in the reactor is slowly increased to 180° C. over 1.75 hours, and is held for 45 additional minutes to complete distillation of methanol at ambient pressure. 12.664 kilograms of methanol are collected.

Step (d): distilling 1,4-butanediol and polycondensation to give PEA-C2C50%

Reactor dome temperature is increased to 130° C. and the vacuum system activated stepwise to a reactor pressure of 7 mbar (0.7 kiloPascals (kPa)) in 1 hour. Temperature in the kneader/devolatizer reactor is kept at 180° C. Then the vacuum is increased to 0.7 mbar (0.07 kPa) for 7 hours while the temperature is increased to 190° C. The reactor is kept for 3 additional hours at 191° C. and with vacuum ranging from 0.87 to 0.75 mbar. At this point a sample of the reactor contents is taken (Preparation 1A); melt viscosities were 6575 megaPascals (MPa) at 180° C. and 5300 MPa at 190° C. The reaction is continued for another 1.5 hours until the final melt viscosities are recorded as 8400 MPa at 180° C. and 6575 MPa at 190° C. (Preparation 1B). Then the liquid Kneader/Devolatizer reactor contents are discharged at high temperature of about 190° C. into collecting trays, the polymer is cooled to room temperature and grinded. Final product is 57.95 kg (87.8% yield) of melt viscosities 8625 MPa at 180° C. and 6725 MPa at 190° C. (Preparation 1C).

Preparations 1A to 1C have the data shown below in Table 3.

TABLE 3

Melt viscosities and molecular weights of samples of MSA Copolyesteramide

| Hours in full vacuum* | Preparation Number | Spindle No. 28** (rpm) | Viscosity at 180° C. (MPa) | Viscosity at 190° C. (MPa) | $M_n$ by 1H-NMR (g/mol) |
|---|---|---|---|---|---|
| 10 | 1A | 20 | 6575 | 5300 | 6450 |
| 11.5 | 1B | 20 | 8400 | 6575 | 6900 |
| 11.5 | 1C | 20 | 8625 | 6725 | 7200 |

*Vacuum < 1.2 mbar

**Viscometer used: Brookfield DV-II+ Viscometer ™

Preparations 2 to 7: composite comprising the PEA-C2C50% of Preparation 1C and CLOISITE™ $Na^+$ Separate weighed samples of the PEA-C2C50% of Preparation 1C are compounded with weighed amounts of CLOISITE™ $Na^+$ according to the compounding procedure for preparing polymer inorganic clay composites described above to give invention polymer inorganic clay composites respectively having 5 wt %, 10 wt %, 20 wt %, 30 wt %, 40 wt %, or 50 wt % of the CLOISITE™ $Na^+$ as shown in Table 4.

TABLE 4 composites of Preparations 2 to 7:

| | Preparation Number: | | | | | |
|---|---|---|---|---|---|---|
| | 2 | 3 | 4 | 5 | 6 | 7 |
| Amount of CLOISITE ™ $Na^+$ (wt %) | 5 | 10 | 20 | 30 | 40 | 50 |

Figure 2:
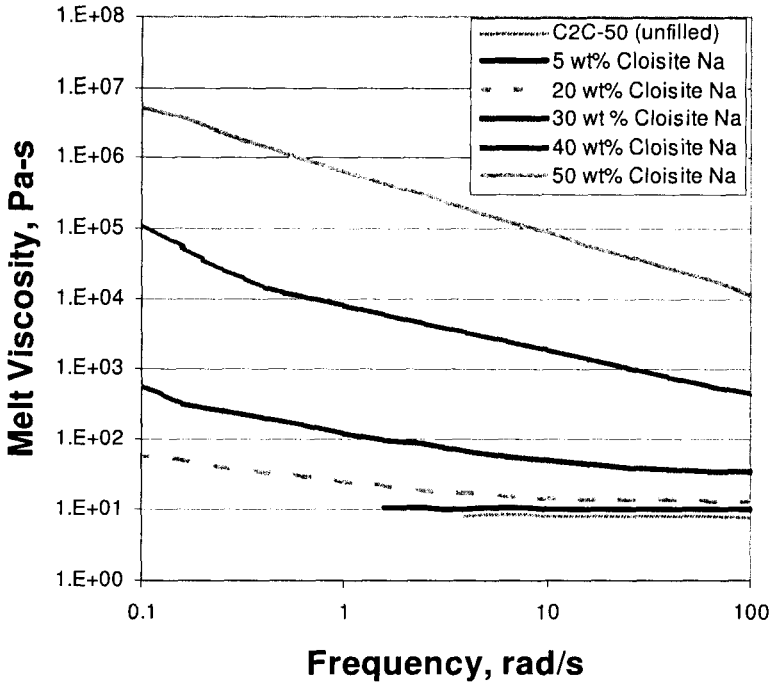
FIG. 2 graphically depicts melt viscosity results for the MSA material of Comparative Example 1 and the CLOISITE™ $Na^+$ composites of Preparations 2 and 4-7.

Separate samples of the composites of Preparations 2 to 7 are compression molded, prepared as plaques, or prepared as flat sheets, and subjected to melt viscosity measurements according to the procedure described above. Melt viscosity results for the composites of Preparations 2 and 4 to 7 are shown as part of FIG. 2. In FIG. 2, the CLOISITE™ $Na^+$ composites of the Preparations are referred to by their respective weight percents of CLOISITE™ $Na^+$.

Preparation 8: composite of $Mg(OH)_2$ and PEA-C2C50% of Preparation 1C

Figure 3:
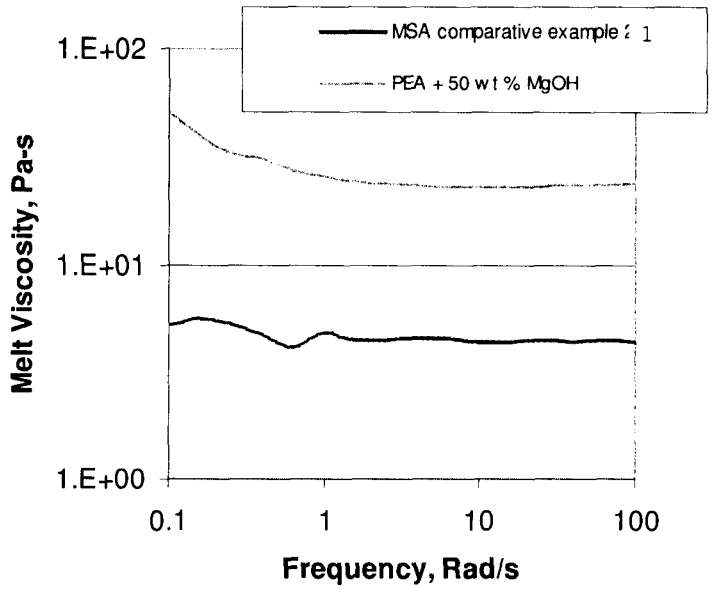
FIG. 3 graphically depicts melt viscosity results for the MSA material of Comparative Example 1 and the magnesium hydroxide ($Mg(OH)_2$) composite of Preparation 8.

Haake blending of 50 wt % PEA-C2C50% of Preparation 1C and 50 wt % of the Dead Sea S-10 grade $Mg(OH)_2$ is carried out as described previously to give a $Mg(OH)_2$ composite having 50 wt % of the $Mg(OH)_2$. Melt viscosity results are shown as part of FIG. 3. FIG. 3 shows that the melt dynamic viscosity of the $Mg(OH)_2$ composite of Preparation 8 is within the range for processing by conventional melt processing techniques (i.e., materials maintain their processability when highly filled).

COMPARATIVE EXAMPLES

Comparative Example 1

Unfilled PEA-C2C50% of Preparation 1C

Separate samples of the PEA-C2C50% of Preparation 1C are compression molded, prepared as plaques and subjected to melt viscosity measurements according to the procedure described above. Melt viscosity results are shown as part of FIGS. 2 and 3. In FIGS. 2 and 3, the unfilled PEA-C2C50% of Preparation 1C is respectively referred to as "C2C-50 (unfilled)" and "MSA comparative example 1."

In FIGS. 3 and 4, "1.E+05," for example, means 1 times 10 to the fifth power.

EXAMPLE(S) OF THE PRESENT INVENTION

Example 1

Preparation of a Polymer Inorganic-Particulate Composite Fiber Comprising the 50 wt % CLOISITE® $Na^+$ Composite of Preparation 7

A sample of approximately 25 grams of the 50 wt % CLOISITE™ $Na^+$ composite of Preparation 7 is packed into a chamber of a Goettfert capillary rheometer (model Gottfert Rheograph 6000 (triple bore system)) having a die with a length of 30 millimeters (mm) The packed sample is allowed to heat to 160° C. Once 160° C. is reached, a rheometer piston moves at 2 mm per second and pushes the composite through a 0.5 millimeter (mm) die hole. The resulting polymer inorganic-particulate composite fiber of Example 1 is collected by hand. A photograph, taken with a Nikon Coolpix L3 digital camera, of the composite fiber of Example 1 (and an inch/centimeter ruler for scale) is shown in FIG. 1. The polymer inorganic-particulate composite fiber of Example 1 is less than 1 millimeter (mm) in diameter and has an aspect ratio of fiber length to fiber diameter of greater than 100:1.

As discussed above, the polymer inorganic-particulate composite, including a highly filled (50 wt % or higher of inorganic particulate) embodiment thereof, is melt processable at temperatures below 200° C. into the polymer inorganic-particulate composite fiber of the first embodiment.

While the invention has been described above according to its preferred embodiments of the present invention and examples of steps and elements thereof, it may be modified within the spirit and scope of this disclosure. This application is therefore intended to cover any variations, uses, or adaptations of the instant invention using the general principles disclosed herein. Further, this application is intended to cover such departures from the present disclosure as come within the known or customary practice in the art to which this invention pertains and which fall within the limits of the following claims.

What is claimed is:

1. A polymer inorganic-particulate composite fiber comprising a molecularly self-assembling (MSA) material and an inorganic particulate dispersed in the MSA material, wherein the inorganic particulate comprises a metal hydroxide or an inorganic clay, the inorganic clay consisting of a cation exchanging layered material and inorganic cations, the cation exchanging layered material having a cation exchanging capacity, the polymer inorganic-particulate composite fiber having an average diameter and the inorganic particulate having at least two dimensions that are less than 10% of the average diameter of polymer inorganic-particulate composite fiber, the inorganic particulate comprising from 1 weight percent (wt %) to 90 wt % of the polymer inorganic-particulate composite fiber based on total weight of the polymer inorganic-particulate composite fiber, and the MSA comprises repeat units of formula I:

Formula I

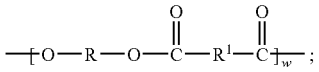

and at least one second repeat unit selected from the ester-amide units of Formula II and III:

Formula II

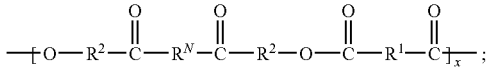

Formula III

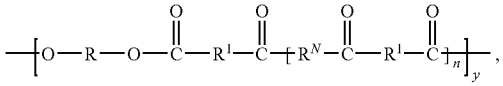

and the ester-urethane units for Formula IV:

Formula IV

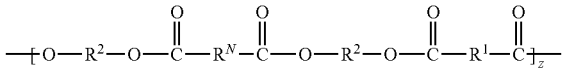

or combinations thereof wherein:

R is at each occurrence, independently a C2-C20 non-aromatic hydrocarbylene group, a C2-C20 non-aromatic heterohydrocarbylene group, or a polyalkylene oxide group having a group molecular weight of from about 100 grams per mole to about 5000 grams per mole;

R1 at each occurrence independently is a bond or a C1-C20 non-aromatic hydrocarbylene group;

R2 at each occurrence independently is a C1-C20 non-aromatic hydrocarbylene group;

RN is —N(R3)-Ra-N(R3)-, where R3 at each occurrence independently is H or a C1-C6 alkylene and Ra is a C2-C20 non-aromatic hydrocarbylene group, or RN is a C2-C20 heterocycloalkyl group containing the two nitrogen atoms, wherein each nitrogen atom is bonded to a carbonyl group according to formula (III) above;

n is at least 1 and has a mean value less than 2; and w represents the ester mol fraction of Formula I, and x, y and z represent the amide or urethane mole fractions of Formulas II, III, and IV, respectively, where w+x+y+z=1, and 0<w<1, and at least one of x, y and z is greater than zero but less than 1.

2. The polymer inorganic-particulate composite fiber as in claim 1, wherein the inorganic particulate comprises the inorganic clay.

3. The polymer inorganic-particulate composite fiber as in claim 1, wherein the inorganic particulate comprises the metal hydroxide.

4. The polymer inorganic-particulate composite fiber as in claim 1, wherein the polymer inorganic-particulate composite fiber has an average diameter of from 0.010 micrometer (μm) to 30 μm.

5. The polymer inorganic-particulate composite fiber as in claim 1, wherein when the MSA material is in a form of a melt, the polymer inorganic-particulate composite fiber being characterized by a zero shear viscosity of less than 10,000, 000 Pascal-seconds at from above Tm up to about 40° C. above Tm of the MSA material.

6. The polymer inorganic-particulate composite fiber as in claim 1, wherein the molecularly self-assembling material is a polyester-amide, polyether-amide, polyester-urethane, polyether-urethane, polyetherurea, polyester-urea, or a mixture thereof.

7. The polymer inorganic-particulate composite fiber as in claim 1, wherein the MSA material comprises self-assembling units comprising multiple hydrogen bonding arrays.

8. The polymer inorganic-particulate composite fiber as in claim 1, wherein the MSA material is of Formula II or III:

Formula II

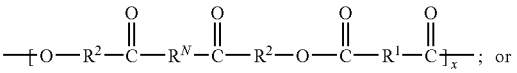

; or

Formula III

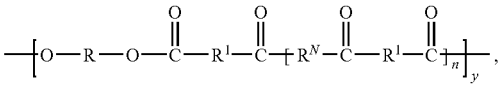

, wherein:

R is at each occurrence, independently a C2-C20 non-aromatic hydrocarbylene group, a C2-C20 non-aromatic heterohydrocarbylene group, or a polyalkylene oxide group having a group molecular weight of from about 100 grams per mole to about 5000 grams per mole;

R1 at each occurrence independently is a bond or a C1-C20 non-aromatic hydrocarbylene group;

R2 at each occurrence independently is a C1-C20 non-aromatic hydrocarbylene group;

RN is —N(R3)-Ra-N(R3)-, where R3 at each occurrence independently is H or a C1-C6 alkylene and Ra is a C2-C20 non-aromatic hydrocarbylene group, or RN is a C2-C20 heterocycloalkyl group containing the two nitrogen atoms, wherein each nitrogen atom is bonded to a carbonyl group according to formula (III) above;

n is at least 1 and has a mean value less than 2; and x and y represent mole fraction wherein $x+y=1$, and $0 \leq x \leq 1$, and $0 \leq y \leq 1$.

9. The polymer inorganic-particulate composite fiber as in claim 1, wherein the number average molecular weight (Mn) of the molecularly self-assembling material is between about 1000 grams per mole and about 50,000 grams per mole.

10. The polymer inorganic-particulate composite fiber as in claim 1, wherein the MSA material itself is characterized by a melt viscosity of less than 100 pascal-seconds (Pa.sec.) at from above melting temperature (Tm) up to about 40 degrees Celsius (° C.) above Tm.

11. The polymer inorganic-particulate composite fiber as in claim 1, wherein the MSA material itself is characterized by a melting temperature (Tm) greater than 60° C. or glass transition temperature (Tg) greater than −80° C.

12. An article comprising the polymer inorganic-particulate composite fiber of claim 1.

13. The article as in claim 12, the article comprising a porous filter medium, wound dressing, textile, carpeting, structure reinforcing material, antistatic medium, conductive medium, catalyst medium, packaging, blow molded article, thermal insulation, electrical insulation, or electrical conductor.

14. The article as in claim 12, the article comprising a medical gown, medical tissue scaffold, cosmetic applicator, sound insulation, barrier material, diaper coverstock, adult incontinence pants, training pants, underpad, feminine hygiene pad, wiping cloth, durable paper, fabric softener, home furnishing, floor covering backing, geotextile, apparel, apparel interfacing, apparel lining, shoe, industrial garment, protective garments and fabrics, agricultural fabric, automotive fabric, automotive component, coating substrate, laminating substrate, leather, or electronic component.

* * * * *